US009738094B2

(12) United States Patent
Tsuchiya et al.

(10) Patent No.: US 9,738,094 B2
(45) Date of Patent: Aug. 22, 2017

(54) INK JET METHOD AND INK JET APPARATUS

(71) Applicant: Seiko Epson Corporation, Tokyo (JP)

(72) Inventors: Hitoshi Tsuchiya, Chino (JP); Masaaki Ando, Matsumoto (JP); Keitaro Nakano, Matsumoto (JP); Hiroaki Kida, Shiojiri (JP); Toshiyuki Yoda, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/067,502

(22) Filed: Mar. 11, 2016

(65) Prior Publication Data

US 2016/0271973 A1 Sep. 22, 2016

(30) Foreign Application Priority Data

Mar. 16, 2015 (JP) ..... 2015-051620

(51) Int. Cl.
*B41J 2/165* (2006.01)
*B41J 2/175* (2006.01)
*B41J 11/00* (2006.01)

(52) U.S. Cl.
CPC ..... *B41J 11/0015* (2013.01)

(58) Field of Classification Search
CPC ..... B41J 2/165; B41J 2/175; B41J 11/0015
See application file for complete search history.

(56) References Cited

U.S. PATENT DOCUMENTS

2008/0079792 A1* 4/2008 Hirato ..... B41J 2/175 347/92
2008/0316244 A1* 12/2008 Lugassi ..... C09D 11/101 347/16
2011/0050794 A1* 3/2011 Koike ..... B41J 2/125 347/22
2014/0132682 A1* 5/2014 Kida ..... C09D 11/38 347/100
2014/0285587 A1* 9/2014 Kida ..... B41J 2/17596 347/85

FOREIGN PATENT DOCUMENTS

JP 2012-020559 A 2/2012

* cited by examiner

*Primary Examiner* — Jason Uhlenhake
(74) *Attorney, Agent, or Firm* — Harness, Dickey & Pierce, P.L.C.

(57) ABSTRACT

An ink jet method includes supplying a radiation curable composition to a discharging head via a composition flow channel; and discharging the radiation curable composition from the discharging head, in which the composition flow channel includes a gear pump that causes the radiation-curable composition to flow in the composition flow channel, and an air supply mechanism that supplies air to the radiation curable composition further to the upstream side in the flow direction than the gear pump.

17 Claims, 3 Drawing Sheets

INK JET METHOD AND INK JET APPARATUS

BACKGROUND

1. Technical Field

The present invention relates to an ink jet method and an ink jet apparatus using the same.

2. Related Art

Because the ink jet method using ultraviolet-curable ink in which a monomer is photopolymerized (cured) through radiation of light is able to form an image with superior waterproofness and abrasion resistance on the recording surface of a recording medium, the method used in color filter manufacturing, in printing (recording) printed substrates, plastic cards, vinyl sheets, large scale signs, and plastic articles, and in printing bar codes or dates.

In order to stably supply the ultraviolet-curable ink from an ink cartridge to a head, it is advantageous to use a gear pump with little vibration. For example, JP-A-2012-20559 discloses a gear pump in which a gas permeable material is used in the components of the gear pump.

However, when ink passes through the gear pump, a problem arises of an ink polymerization reaction occurring in the gear pump due to the frictional heat of the gears in the gear pump, and the polymerization product fixing to and stopping the gears of the gear pump. The effect of suppressing the polymerization reaction of the ink composition in the gear pump by simply configuring the gear pump so that minute amounts of oxygen are incorporated using a gas permeable material in the components of the gear pump as in the apparatus disclosed in JP-A-2012-20559 is still insufficient.

In contrast, transporting the ultraviolet-curable ink composition using a tube pump or a diaphragm pump is also considered. In such methods, there is little fixing of the polymerization product. However, tube pumps have a problem of durability in that the tube is easily damaged. Because it is difficult for a diaphragm pump to transport liquids with a fixed flow rate, there are problems with discharge amount stability.

SUMMARY

An advantage of some aspects of the invention is to provide an ink jet method and an ink jet apparatus using the same with superior durability and discharge amount stability.

The present inventors have conducted intensive research in order to solve the above problems. As a result, it was discovered that it is possible to resolve the above problems by providing an air supply mechanism to the upstream of the gear pump, and the invention was completed.

(1) According to an aspect of the invention, there is provided an ink jet method including supplying a radiation curable composition to a discharging head via a composition flow channel; and discharging the radiation curable composition from the discharging head, in which the composition flow channel includes a gear pump that causes the radiation-curable composition to flow in the composition flow channel, and an air supply mechanism that supplies air to the radiation curable composition further to the upstream side in the flow direction than the gear pump.

(2) In the ink jet method according to (1), the air supply area of the air supply mechanism may be 0.3 $m^2$ to 1.0 $m^2$.

(3) In the ink jet method according to (1) or (2), the ink flow rate of the air supply mechanism may be 50 g/min to 400 g/min.

(4) In the ink jet method according to any one of (1) to (3), the dissolved oxygen amount in the radiation curable composition that flows into the gear pump may be 6.0 ppm to 30 ppm.

(5) The ink jet method according to any one of (1) to (4) may further include a degassing mechanism that performs degassing on the radiation curable composition, further to the downstream side than the gear pump.

(6) In the ink jet method according to any one of (1) to (5), the dissolved oxygen amount in the radiation curable composition supplied to the discharging head may be 3.0 to 20.0 ppm.

(7) In the ink jet method according to any one of (1) to (6), the dissolved oxygen amount in the radiation curable composition immediately before being supplied to the air supply mechanism may be 5 ppm or less.

(8) The ink jet method according to any one of (1) to (7), the dissolved oxygen amount added by the air supply mechanism may be 5 to 40 ppm.

(9) According to another aspect of the invention, there is provided an ink jet apparatus that performs recording with the ink jet method according to any one of (1) to (8).

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
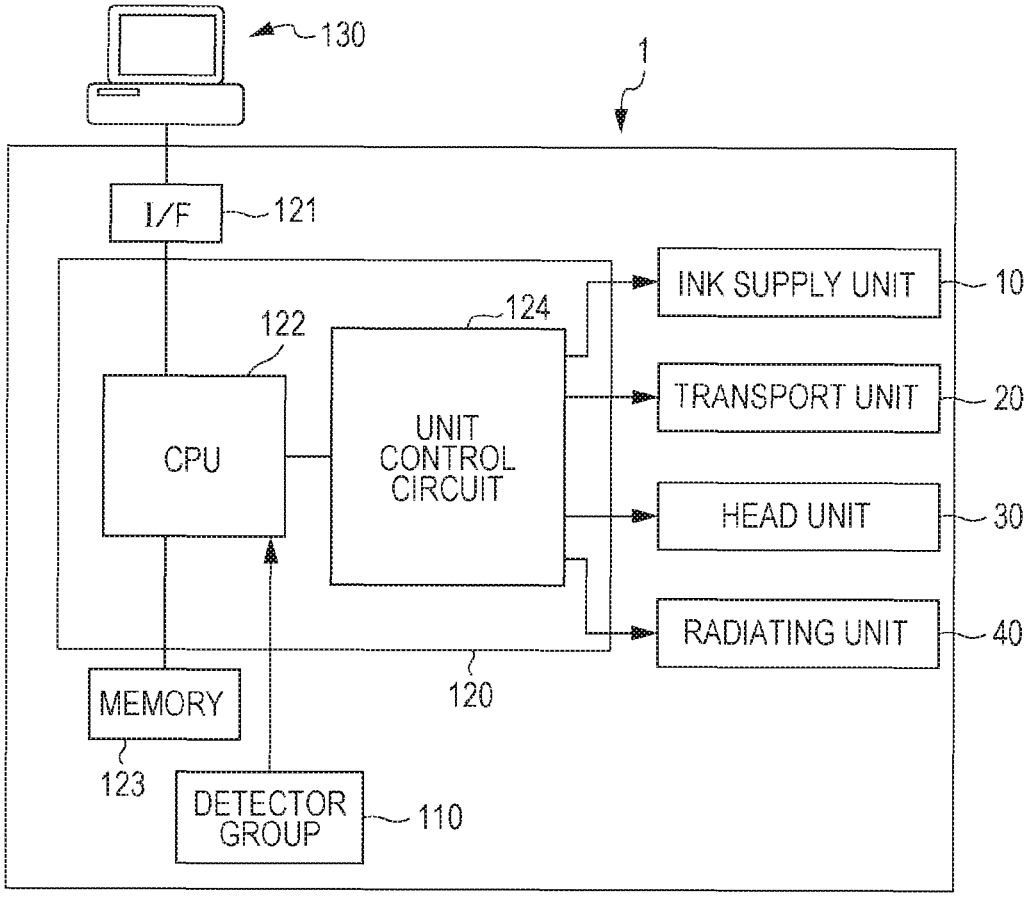
FIG. 1 is a block diagram showing an example of a configuration of an ink jet apparatus of the embodiment.

Below, although forms (below, referred to as embodiments) for carrying out the invention are described in detail while referring to the drawings as necessary, the invention is not limited thereto, and various modifications are possible in a range not departing therefrom. In the drawings, like elements are given like references, and overlapping explanation thereof will not be provided. Unless otherwise noted, positional relationships, such as up, down, left, and right, are based on the positional relationships shown in the drawings. Furthermore, the dimensions and ratios in the drawings are not limited to the ratios depicted.

Ink Jet Method

The ink jet method of the embodiment includes a step of supplying a radiation-curable composition to the discharging head via the composition flow channel, and a step of discharging the radiation-curable composition from the discharging head. The composition flow channel includes a gear pump that causes the radiation-curable composition to flow in the composition flow channel, and an air supply mechanism that supplies air to the radiation-curable composition further to the upstream side than the gear pump. In so doing, it is possible for the ink jet apparatus to be used with durability and good discharge amount stability. Below, an embodiment of the ink jet method and the ink jet apparatus that uses the ink jet method will be described.

Ink Jet Apparatus

The ink jet apparatus of the embodiment is not particularly limited, as long as it performs recording with the ink jet method of the embodiment. The ink jet apparatus of the embodiment is provided with a head (discharging head) that discharges a radiation-curable composition such as an ultraviolet-curable ink composition, an ink flow channel (composition flow channel) that supplies the ultraviolet-curable ink composition to the head, and a gear pump that causes the ultraviolet-curable ink composition to flow in the ink flow channel an air supply mechanism that supplies air to the ultraviolet-curable ink composition further to the upstream side in the flow direction than the gear pump. In the embodiment, the ink jet apparatus is provided with a gear pump that causes the ink composition to flow in the ink flow channel. Here, the wording "ink flow channel" refers to a flow channel for allowing the ink composition to flow in the ink jet apparatus. Examples of the ink flow channel include an ink supply channel for supplying the ink composition from an ink accommodation container that stores the ink composition to the ink jet recording head, a flow channel for causing the ink composition to flow in the ink jet recording head up to a nozzle opening, and the following ink circulation path.

FIG. 1 is a block diagram showing an example of a configuration of an ink jet apparatus (below also referred to as a "printer") of the embodiment. A computer 130 outputs printing data for forming an image with a printer 1 and that corresponds to the image to the printer 1. The printer 1 is an recording apparatus that forms an image on a recording medium, and is connected to be able to communicate with the computer 130 that is an external apparatus.

The printer 1 includes an ink supply unit 10, a transport unit 20, a head unit 30, a radiating unit 40, a detector group 110, a memory 123, an interface 121, and a controller 120. The printer 1 that receives the printing data from the computer 130 controls each unit with the controller 120, and records the image on the recording medium according to the printing data. The situation inside the printer 1 is monitored by the detector group 110, and the detector group 110 outputs the detection results to the controller 120. The controller 120 controls each unit based on the detection results output from the detector group 110. The controller 120 stores the printing data input via the interface 121 in the memory 123, and includes a CPU 122 and a unit control circuit 124. Control information for controlling each unit is also stored in the memory 123.

It is preferable that the ink jet apparatus is a line printer. In the case of a line printer, because the durability of the gear pump becomes a particular problem since the supply amount of the ink composition is large, the ink jet apparatus of the embodiment is particularly useful.

Figure 2:
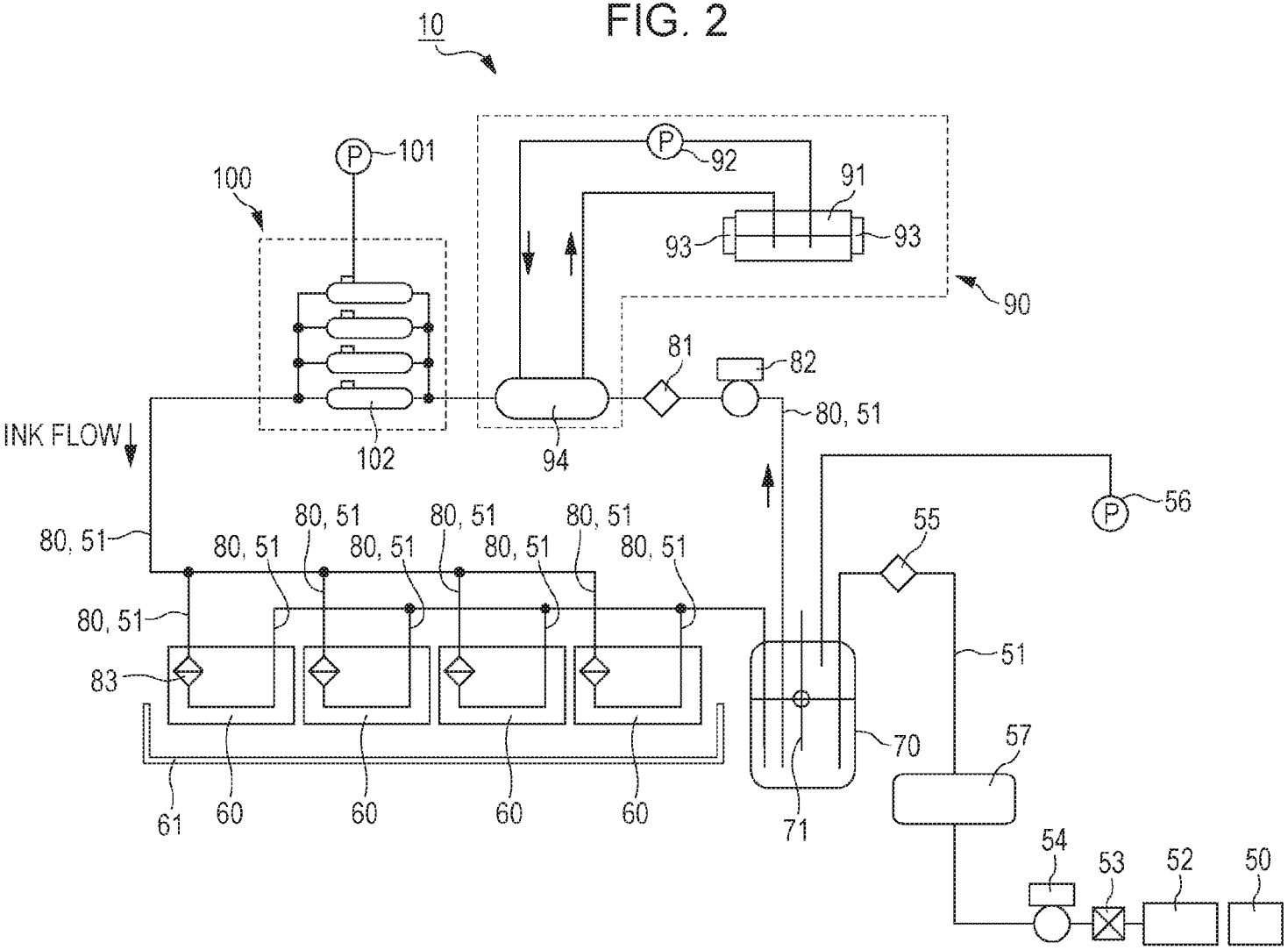
FIG. 2 is a diagram showing an example of an ink supply unit included in the ink jet apparatus of the embodiment.

FIG. 2 shows an example of an ink supply unit included in the ink jet apparatus of the embodiment. The ink supply is positioned between ink cartridge 50 and the head 60 within the ink jet apparatus. The ink supply device 10 includes an ink cartridge 50, an ink flow channel 51 (preferable an ink flow channel 51 that includes an ink circulation path 80), a sub-tank 70, and a head 60. The head 60 belongs to the above-described head unit 30.

A holder 52, a valve 53, a supply pump 54, an air supply device (air supply mechanism) 57, and a filter 55 are provided in the pipe between the ink cartridge 50 and the sub-tank 70 within the ink flow channel 51.

In FIG. 2, it is possible for the ink flow channel to include the ink circulation path 80, the ink circulation path 80 to pass through the sub-tank 70 and the head 60, the ink composition to be supplied from the sub-tank 70, and to supply the ink composition to the head 60. In this way, by the ink composition being circulated by the ink circulation path 80, it is possible for the temperature of the ink composition heated by a warming device 90, described later, to be constant, to further increase the degassing efficiency, for the ink composition to be caused to constantly flow, and to prevent precipitation of the components included in the ink composition.

The ink circulation path 80 may include a filter 81, a circulation pump 82, a warming device 90, a degassing device 100 and a head filter 83. The filter 81 is provided to the downstream of the circulation pump 82 of the ink circulation path 80, and filters foreign materials in the ink composition. A portion of the ink circulation path 80 is provided in the head 60, and at least a portion of the ink composition that circulates is discharged by the head 60 via the head filter 83 that filters foreign materials in the ink composition.

In FIG. 2, a gear pump is employed as the circulation pump 82, and a diaphragm pump is employed as the supply pump 54.

Air Supply Device (Air Supply Mechanism)

The ink jet apparatus includes an air supply device (air supply mechanism) that supplies air to the ink composition further to the upstream side in the flow direction than the gear pump. In the example shown in FIG. 2, although the air supply device 57 is arranged to the upstream of the sub-tank 70, the air supply device 57 may be arranged to the upstream of the gear pump 82 in the ink circulation path 80. In the air supply device, the air supply step for supplying air to the radiation-curable composition (ink composition) of the composition flow channel (ink flow channel) as above is performed.

The air supply device 57 is provided with an air supply membrane that allows gas to pass through and blocks liquids on the surface of a portion of the ink flow channel into which the ink composition flows, and is configured so that air from the external atmosphere passes through the air supply membrane and is supplied to the ink composition. The external atmosphere is a state of being open to the atmosphere or is pressurized. The air supply device 57 may be provided with a plurality of air supply modules formed from the ink flow channels provided with the air supply membrane. It is possible for the dissolved oxygen amount in the ink composition to be increased by the air supply device 57, and the oxygen acts as a polymerization inhibitor. Therefore, it is possible to prevent the ink composition in the gear pump 82 from polymerizing. Therefore, it is possible to suppress a lowering of the durability of the gear pump 82 due to the polymerization products fixing to the gears of the gear pump. A hollow fiber membrane able to adjust the oxygen supply amount according to the surface thereof is preferably used as the air supply membrane.

For example, the dissolved oxygen amount in the ultraviolet-curable ink composition immediately before being supplied to the air supply mechanism 57 is 5 ppm or less. When such an ink composition flows into the gear pump 82 as is, since there is potential for the polymerization reaction of the ink to occur within the gear pump 82, the invention is advantageously applied. Although it is possible for the dissolved oxygen amount in the specification to be measured by methods known in the related art, values obtained by the measurement method carried out in the examples, described later, are employed.

It is preferable for the air supply area of the air supply device 57 to be 0.3 $m^2$ to 1.0 $m^2$, it is preferable for the lower limit to be 0.35 $m^2$ or more with 0.4 $m^2$ or more being more preferable, and it is preferable for the upper limit to be 0.6 $m^2$ or less. The air supply area is the surface area to which the ink is supplied with air in the air supply device 57, that is, the surface area of the air supply film. In a case where the air supply device 57 is provided with a plurality of air supply modules, the air supply surface area of the air supply device 57 is the area in which the surface areas of all air supply modules is totaled. By setting the air supply area of the air supply device 57 to the above values, it is possible to stipulate the oxygen incorporation amount to a fixed range, and possible to achieve both durability and discharge stability of the gear pump.

The dissolved oxygen amount added by the air supply mechanism 57 is preferably 5 ppm to 40 ppm, and the lower limit is preferably 3 ppm or more, 10 ppm or more is more preferable, and the upper limit is preferably 35 ppm or less, ppm or less is more preferable and 20 ppm or less is still more preferable. In so doing, it is possible to supply sufficient oxygen in order to suppress the polymerization reaction in the gear pump.

The ink flow rate in the air supply mechanism 57 is g/min to 400 g/min, the lower limit is preferably 100 g/min or more, and 150 g/min or more is more preferable, and the upper limit is preferably 350 g/min or less. If the flow rate is set to these ranges, it is possible to supply a sufficient amount of oxygen with the air supply device 57.

It is preferable that the dissolved oxygen amount in the ultraviolet-curable ink composition that flows into the gear pump is 6.0 ppm to 30 ppm, the lower limit is preferably 5 ppm or more, 10 ppm or more is more preferable and 15 ppm or more is particularly preferable, and the upper limit is preferably 40 ppm or less, 35 ppm or less is more preferable, and 20 ppm or less is particularly preferable. In so doing, it is possible to suppress the polymerization reaction of the ink composition within the gear pump.

In the example shown in FIG. 2, ink with a low dissolved oxygen amount (for example, 3 ppm to 10 ppm) passing through the head 60 and new ink to which oxygen is supplied by the air supply device 57 are missed in the sub-tank 70, and the dissolved oxygen amount is set to become a constant 6.0 ppm to 30 ppm in the gear pump 82.

Gear Pump

The ink jet apparatus is provided with a gear pump that causes the ink composition to flow in the ink flow channel. By using the gear pump, the durability and the discharge amount stability of the ink jet apparatus improve. There is no particular limitation as long as the gear pump is installed in the ink flow channel and the ink is caused to pass through the ink flow channel, and examples of the installation position include the position of the circulation pump 82 shown in FIG. 2.

Figure 3:
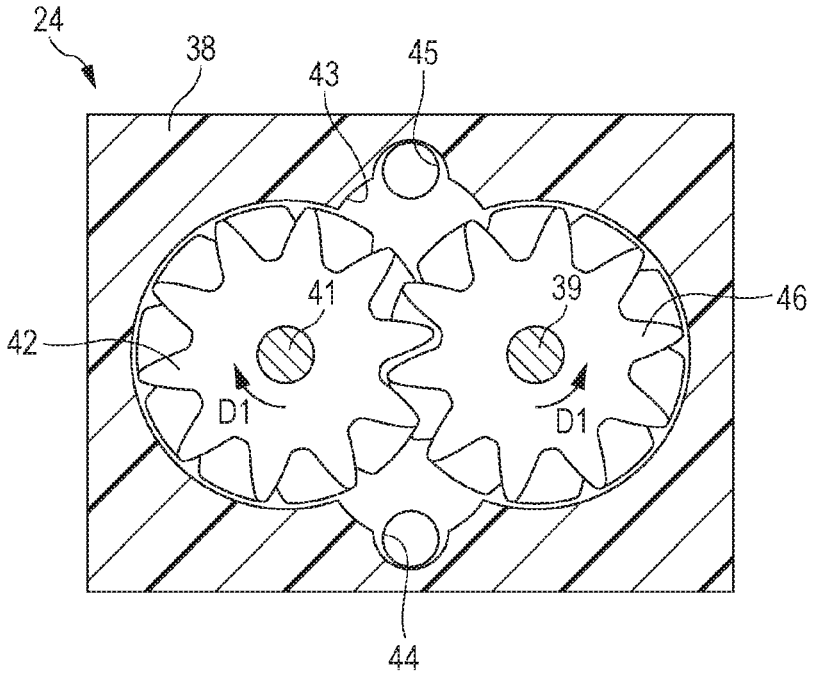
FIG. 3 is a cross-sectional schematic diagram showing an example of a gear pump used in the embodiment.

FIG. 3 is a cross-sectional schematic diagram showing an example of a gear pump used in the embodiment. As shown in FIG. 3, the gear pump 24 is provided with a case 38, drive shaft 39, a driving gear 46 that rotates integrally with the drive shaft 39, a driven shaft 41, and a driven gear 42 that rotates integrally with the driven shaft 41. That is, the driving gear 46 and the driven gear 42 functions as a rotating body centered on the drive shaft 39 and the driven shaft 41 as shafts.

In FIG. 3, the drive shaft 39 and the driven shaft are provided in a form parallel to one another. The driving gear 46 and the driven gear 42 are a pair of gears rotatable to one another, specifically, helical gears, and are accommodated in a pump chamber 43 (fluid chamber) in a state of being meshed with one another. A suction port 44 and a discharge port 45 connected to the ink circulation path 80 are formed in the pump chamber 43. When the drive shaft 39, the driving gear 46, the driven shaft 41, and the driven gear 42 rotate in the forward direction D1 shown by the arrow in FIG. 3, the gear pump 24 suctions the ink composition from the suction port 44 according to the rotary movement of the driving gear 46 and the driven gear 42, and discharges the ink composition from the discharge port 45 while the ink composition is caused to flow in the pump chamber 43.

The gear pump 24 preferably includes a non-metallic material on at least the surface of the engagement portion of the gear 46 that is a member having an engagement portion (groove) that contacts the ink and with which the member engages another member, and preferably includes at least one type selected from a group including polyphenylene sulfide, polyethylene terephthalate, polybutylene terephthalate, and ceramics. It is preferable that the ceramic is at least one of a metal oxide, a metal carbide, a metal nitride, a metal boride or the like. In so doing, the durability of the ink jet apparatus is further improved. Although it is inferred that the cause of the durability improving is that because these materials have little swelling of the member due to the ink components when the ink comes in contact with the member, or there are few impurities included in these materials because there is little generation of foreign materials from the components included in the ink stemming from the impurities, and little impediment arises to the rotation by generating defects in the engagement of the member according to the swelling or foreign materials, the cause is not limited thereto. Although it is also possible to make at least the surface of the case 38 that contacts the ink from the above materials, the surface may be formed using a material (such as polyacetal, polypropylene, polyethylene, polycarbonate, silicone rubber) having gas permeability (oxygen permeability). In so doing, it is possible to further suppress fixing of the ink composition within the gear pump 24, and the durability of the ink jet apparatus further improves.

It is preferable that the ink composition feed amount of the gear pump 24 is 10 g/min or more, 50 g/min or more is more preferable, 70 g/min or more is still more preferable, 100 g/min or more is particularly preferable, and 200 g/min or more is even more preferable. It is preferable that the ink composition feed amount is 400 g/min or less, and 300 g/min or less is more preferable. A case where the feed amount is within the above ranges is preferable on the features of being able to suppress heat locally generated at the engagement portion of the gear 46 while ensuring the printing speed by supplying an ink amount necessary for printing to the head, and durability of the gear pump 24. In a case of including a circulation path in which the ink composition circulates, the dissolved oxygen and temperature of the ink composition become easily held within predetermined ranges. Therefore, by the ink composition feed amount being within the above ranges, it is possible to more stably supply the ink composition, and the dissolved oxygen amount and temperature of the ink composition become more stable, and furthermore the durability of the gear pump 24 further improves.

Warming Device

It is preferable that the ink jet apparatus further include a warming device (for example, the warming device 90 shown in FIG. 2) for warming the ink jet ink composition in the ink flow channel. In a case of including a warming device, thickened materials tend to be easily generated in the ink composition by the temperature of the ink composition being high. When thickened materials are generated, the gear pump becomes easily fixed. Therefore, the ink jet apparatus according to the embodiment is particularly useful in a case of including the warming device. It is preferable that the warming temperature is 35° C. to 70° C.

Although the warming device 90 is not particularly limited as long as it is provided in the ink flow channel, the warming device is provided in the ink circulation path 80 in FIG. 2, and more specifically, is positioned partway along the ink circulation path 80, that is, between the sub-tank 70 and the head 60. It is preferable that the warming device 90 is further downstream than the gear pump in the direction that the ink is supplied, and is positioned further upstream than the head 60. By doing so, it is possible to further improve the durability of the gear pump by the ink flowing into the gear pump before being heated by the warming device. The warming device 90 heats the ink composition. It is possible to control the discharge temperature and discharge viscosity of the discharged ultraviolet-curable ink composition with the warming device. It is preferable that the discharge temperature is 28 to 50° C., 28° C. to 45° C. is more preferable, and 28° C. to 40° C. is still more preferable. It is preferable that the discharge viscosity is 15 mPa·S or less, and 5 mPa·S to 15 mPa·S is more preferable.

Although the warming device 90 is not particularly limited, examples include warming devices that heat the ink composition in the ink circulation path 80 with a temperature adjusting module 94 while causing warm water from the warm water tank 91 to circulate between the temperature adjusting module 94 and the warm water tank 91 by the warm water circulation pump 92. The heater 93 of the warm water tank 91 adjusts the temperature of the ink composition that circulates to a target temperature.

Degassing Device

It is preferable that the ink jet apparatus includes a degassing device (degassing mechanism) 100 that degasses the ink composition further to the downstream side in the flow direction than the gear pump 82. The ink composition that is degassed by the degassing device 100 is supplied to the head 60. It is preferable that the degassing device 100 is provided further to the downstream side than the warming device 90 (more specifically, the temperature adjusting module 94 of the ink circulation path 80) that is the direction in which the ink composition is supplied and further to the upstream side than the head 60. By positioning the degassing device 100 to the downstream of the warming device 90, degassing is performed in a state where the temperature of the ink composition is high, and it is possible for the degassing efficiency to be further increased. The degassing module 102 is provided with a degassing chamber (not shown) that the ink composition flows into, and a decompression chamber (not shown) that contacts the degassing chamber via an isolation membrane that fluids, such as ink composition, do not pass through. The negative pressure pump 101 reduces the pressure in the decompression chamber. When the pressure is reduced in the decompression chamber, air bubbles are removed by reducing the amount of dissolved air in the ink composition in the ink circulation path 80. In this way, it is possible for the degassing device 100 to degas the ink composition within the ink circulation path 80.

Although not particularly limited, examples of the degassing device include degassing devices including an isolation membrane that performs degassing while feeding the ink composition.

The degassing device 100 is controlled so that the dissolved oxygen amount in the ink composition supplied to the head becomes sufficiently low. In so doing, it is possible for the polymerization reaction of the ink composition to be promoted during recording. Specifically, the dissolved oxygen amount in the ink composition supplied to the head is 3.0 ppm to 20.0 ppm, the lower limit is preferably 5 ppm or more, and 15 ppm or less is more preferable, and 10 ppm or less is still more preferable.

In the ink jet apparatus and the ink jet method with the above configuration, the ink composition flows from the ink cartridge 50 through the ink flow channel 51 due to the supply pump 54, and is carried to the sub-tank 70 through the air supply device 57. The ink composition transported to the sub-tank 70 is sequentially filled in the ink circulation path 80 from the sub-tank 70 according to the consumption of the ink composition from the head 60. The ink composition transported to the ink circulation path 80 is circulated in the ink circulation path 80 due to the gear pump (circulation pump 82), and passes through the warming device 90 and the degassing device 100 to be supplied to the head 60 via the head filter 83. At least a portion of the ink composition supplied to the head 60 is discharged by the head 60.

Radiation-Curable Composition

Next, the ultraviolet-curable ink composition will be described as an example of the radiation-curable composition. It is possible for the ink composition to include each of the components shown as examples below.

Photopolymerization Initiator

It is possible for the ink composition according to the embodiment to include a polymerization initiator. The photopolymerization initiator is used in order to form printed characters with ink present on the surface of the recording medium being cured by photopolymerization due to the radiation of ultraviolet rays. The ink jet apparatus according to the embodiment has superior safety and is able to suppress the cost of the light source by using ultraviolet rays (UV) from the radiation. The photopolymerization initiator is not limited as long as it generates active species such as radicals or cations through the energy of light (ultraviolet rays), and causes the polymerization of the polymerizable compound to begin, and it is possible to use an photoradical polymerization initiator, or a cationic polymerization initiator. Among these, it is preferable to use a photoradical polymerization initiator. When the photoradical polymerization initiator is used, the polymerization tends to easily proceed in a case where there is little oxygen. Therefore, the ink composition in the gear pump that easily attains an oxygen poor state tends to thicken, and the ink jet apparatus of the embodiment becomes particularly useful.

Although not particularly limited, examples of the photoradical polymerization initiator include aromatic ketones, acylphosphine oxide compounds, thioxanthone compounds, aromatic onium compounds, organic peroxides, thio compounds (thiophenyl group-containing compounds and the like), α-aminoalkyl phenol compounds, hexaarylbiimidazole compounds, ketoxime ester compounds, borate compounds, ajinium compounds, metallocene compounds, active ester compounds, compounds having a carbon-halogen bond, and alkyl amine compounds.

Among these, an acylphosphine oxide-based photopolymerization initiator (acylphosphine oxide compound) and a thioxanthone-based photopolymerization initiator (thioxanthone compounds) are preferable, and an acylphosphine oxide photopolymerization initiator is more preferable. The curing process using a UV-LED is superior, and the curing properties of the ink composition are much superior by using the acylphosphine oxide-based photopolymerization initiator and the thioxanthone-based photopolymerization initiator, and in particular the acylphosphine oxide-based photopolymerization initiator. When these photopolymerization initiators are used, since it is necessary to lower the dissolved oxygen amount in the ink for the ink composition in the gear pump tend to further thicken and for the discharge stability to tend to worsen in a case where the dissolved oxygen amount in the ink is high, the durability becomes disadvantageous, and the ink jet method of the embodiment is particularly useful.

Although not particularly limited, specific examples of the acylphosphine oxide-based photopolymerization initiator include bis(2,4,6-trimethylbenzoyl)-phenylphosphine oxide, 2,4,6-trimethylbenzoyl-diphenyl-phosphine oxide, and bis-(2,6-dimethoxybenzoyl)-2,4,4-trimethylpentyl phosphine oxide.

Although not particularly limited, commercially available acylphosphine oxide-based photopolymerization initiators include IRGACURE 819 (bis(2,4,6-trimethylbenzoyl)-phenylphosphine oxide), and DAROCUR TPO (2,4,6-trimethylbenzoyl-diphenyl-phosphine oxide).

It is preferable that the content of the acylphosphine oxide-based photopolymerization initiator is 2 to 15 mass % to the total mass (100 mass %) of the ink composition, and 5 to 13 mass % is more preferable, and 7 to 13 mass % is still more preferable. When the content is 2 mass % or more, the curing properties of the ink tend to be further superior. When the content is 13 mass % or less, the discharge stability tends to further improve.

Although not particularly limited, it is preferable that the thioxanthone-based photopolymerization initiator specifically include at least one type selected from a group consisting of thioxanthone, diethyl thioxanthone, isopropyl thioxanthone, and chlorothioxanthone. Although not particularly limited, it is preferable that the diethyl thioxanthone is 2,4-diethyl thioxanthone, that the isopropyl thioxanthone is 2-isopropyl thioxanthone, and that the chlorothioxanthone is 2-chlorothioxanthone. If the ink composition that include such thioxanthone-based photopolymerization initiators tends to have still superior curing properties, storage stability, and discharge stability. Among these, a thioxanthone-based photopolymerization initiator that includes diethyl thioxanthone is preferable. By including diethyl thioxanthone, a wide range of ultraviolet light (UV light) tends to be more efficiently convertible to active species.

Although not particularly limited, examples of the commercially available thioxanthone-based photopolymerization initiators specifically include Speedcure DETX (2,4,-diethyl thioxanthone), Speedcure ITX (2-isopropyl thioxanthone) (both manufactured by Lambson Limited), and KAYACURE DETX-S (2,4-diethyl thioxanthone) (manufactured by Nippon Kayaku Co., Ltd.).

It is preferable that the content of the thioxanthone-based photopolymerization initiator is 0.5 to 4 mass % to the total mass (100 mass %) of the ink composition, and 1 to 4 mass % is more preferable. When the content is 0.5 mass % or more, the curing properties of the ink tend to be further superior. When the content is 4 mass % or less, the discharge stability is still superior.

Although not particularly limited, examples of the other photoradical polymerization initiator include acetophenone, acetophenone benzyl ketal, 1-hydroxy phenyl ketone, 2,2-dimethoxy-2-phenyl acetophenone, xanthone, fluorenone, benzaldehyde, fluorene, anthraquinone, triphenylamine, carbazole, 3-methyl-acetophenone, 4-chlorobenzophenone, 4,4'-dimethoxy benzophenone, 4,4'-amino benzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenyl-propan-1-one, and 2-methyl-1-[4-(methylthio)phenyl]-2-morpholino-propan-1-one.

Although not particularly limited, examples of commercially available photoradical polymerization initiator include IRGACURE 651 (2,2-dimethoxy-1,2-diphenylethane-1-one), IRGACURE 184 (1-hydroxy-cyclohexyl-phenyl-ketone), DAROCUR 1173 (2-hydroxy-2-methyl-1-phenyl-propan-1-one), IRGACURE 2959 (1-[4-(2-hydroxyethoxy)-phenyl]-2-hydroxy-2-methyl-1-propan-1-one), IRGACURE 127 (2-hydroxy-1-{4-[4-(2-hydroxy-2-methyl-propionyl)-benzyl]phenyl}-2-methyl-propan-1-one), IRGACURE 907 (2-methyl-1-(4-methylthiophenyl)-2-morpholino-propan-1-one), IRGACURE 369 (2-benzyl-2-dimethylamino-1-(4-morpholinophenyl)-butanone-1), IRGACURE 379 (2-(dimethylamino)-2-[(4-methylphenyl)methyl]-1-[4-(4-morpholinyl)phenyl]-1-butanone), IRGACURE 784 (bis(η5-2,4-cyclopentadiene-1-yl)-bis(2,6-difluoro-3-(1H-pyrrol-1-yl)-phenyl) titanium), IRGACURE OXE 01 (1,2-octanedione, 1-[4-(phenylthio)-, 2-(O-benzoyl oxime)]), IRGACURE OXE 02 (ethanone, 1-[9-ethyl-6-(2-methylbenzoyl)-9H-carbazol-3-yl]-, 1-(O-acetyloxime)), IRGACURE 754 (mixture of oxy-phenyl acetic acid, 2-[2-oxo-2-phenyl acetoxyethoxy]ethyl ester and oxy-phenyl acetic acid, and 2-(2-hydroxyethoxy) ethyl ester) (all manufactured by BASF Corporation), Speedcure TPO (manufactured by Lambson Limited), Lucirin TPO, LR8893, LR8970 (all manufactured by BASF Corporation), and Ubecryl P36 (manufactured by UCB Inc.).

Although not particularly limited, examples of the cationic polymerization initiator specifically include sulfonium salts, and iodonium salts. Although not particularly limited, examples of the commercially available cationic polymerization initiator specifically include IRGACURE 250 and IRGACURE 270.

The photopolymerization initiators may be used independently, or two or more may be used in combination.

It is preferable that the content of the other photopolymerization initiator is 5 to 20 mass % to the total mass (100 mass %) of the ink composition. When the content is in the above ranges, it is possible for the ultraviolet curing speed to be sufficiently exhibited, and to avoid coloring derived from dissolved remainder of the photopolymerization initiator or the photopolymerization initiator.

Polymerizable Compound

The ink composition may include a polymerizable compound. It is possible for the polymerizable compound to be polymerized during light radiation independently or through the action of the polymerization initiator, and for the printed ink composition to be cured. Although not particularly limited, specifically, mono-, bi-, and tri-functional or higher polyfunctional monomers and oligomers known in the related art are usable as the polymerizable compound. The other polymerizable compounds may be used independently, or two or more may be used in combination. Below, these polymerizable compounds are shown as examples.

Although not particularly limited, examples of the mono-functional, bi-functional, and tri-functional or higher polyfunctional monomer include unsaturated carboxylic acids such as (meth)acrylic acid, itaconic acid, crotonic acid, isocrotonic acid and maleic acid; salts of unsaturated carboxylic acid; esters urethanes, amides and anhydrides of unsaturated carboxylic acids; acrylonitrile, styrene, various unsaturated polyesters, unsaturated polyethers, unsaturated polyamides, and unsaturated urethanes. Examples of the mono-functional, bi-functional and tri-functional or higher polyfunctional oligomer include oligomers formed from the above monomers, such as linear acrylic oligomers, epoxy (meth)acrylates, oxetane (meth)acrylates, aliphatic urethane (meth)acrylates, aromatic urethane (meth)acrylates and polyester (meth)acrylates.

The composition may include an N-vinyl compound as the other mono-functional monomer and polyfunctional monomer. Although not particularly limited, examples of the N-vinyl compound include an N-vinyl formamide, an N-vinylcarbazole, an N-vinylacetamide, an N-vinyl pyrrolidone, an N-vinylcaprolactum, and acryloyl morpholine and derivatives thereof.

Among the polymerizable compounds, esters of (meth) acrylic acid, that is (meth)acrylate, are preferable.

Although not particularly limited, examples of the mono-functional (meth)acrylate include isoamyl (meth)acrylate, stearyl (meth)acrylate, lauryl (meth)acrylate, octyl (meth) acrylate, decyl (meth)acrylate, isomyristyl (meth)acrylate, isostearyl (meth)acrylate, 2-ethylhexyl diglycol (meth)acrylate, 2-hydroxybutyl (meth)acrylate, butoxyethyl (meth) acrylate, ethoxy diethylene glycol (meth)acrylate, methoxy diethylene glycol (meth)acrylate, methoxy polyethylene glycol (meth)acrylate, methoxy propylene glycol (meth) acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxy propyl (meth)acrylate, lactone-modified flexible (meth)acrylate, t-butyl cyclohexyl (meth)acrylate, dicyclopentanyl (meth)acrylate, and dicyclopentenyloxyethyl (meth)acrylate. Among these, phenoxyethyl (meth) acrylate is preferable.

The content of the mono-functional (meth)acrylate is preferably 30 to 85 mass % to the total mass (100 mass %) of the ink composition, and 40 to 75 mass % is more preferable. By setting the above preferable ranges, the curing properties, the initiator solubility, the storage stability, and the discharge stability tend to be further superior.

Examples of the mono-functional (meth)acrylate include those containing a vinyl ether group. Although not particularly limited, examples of the mono-functional (meth)acrylate include 2-vinyloxyethyl (meth)acrylate, 3-vinyloxypropyl (meth)acrylate, 1-methyl-2-vinyloxyethyl (meth) acrylate, 2-vinyloxypropyl (meth)acrylate, 4-vinyloxybutyl (meth)acrylate, 1-methyl-3-vinyloxypropyl (meth)acrylate, 1-vinyloxymethyl propyl(meth)acrylate, 2-methyl-3-vinyloxypropyl(meth)acrylate, 1,1-dimethyl-2-vinyloxyethyl (meth)acrylate, 3-vinyloxybutyl (meth)acrylate, 1-methyl-2-vinyloxypropyl(meth)acrylate, 2-vinyloxybutyl (meth)acrylate, 4-vinyloxyethyl cyclohexyl (meth)acrylate, 6-vinyloxyhexyl (meth)acrylate, 4-vinyloxymethyl cyclohexyl methyl (meth)acrylate, 3-vinyloxymethyl cyclohexyl methyl (meth)acrylate, p-vinyloxymethyl phenyl methyl (meth) acrylate, m-vinyloxymethyl phenyl methyl (meth)acrylate, o-vinyloxymethyl phenyl methyl (meth)acrylate, 2-(vinyloxyethoxy) ethyl (meth)acrylate, 2-(vinyloxyisopropoxy) ethyl (meth)acrylate, 2-(vinyloxyethoxy) propyl (meth)acrylate, 2-(vinyloxyethoxy) isopropyl (meth)acrylate, 2-(vinyloxyisopropoxy) propyl (meth)acrylate, 2-(vinyloxyisopropoxy) isopropyl (meth)acrylate, 2-(vinyloxyethoxyethoxy) ethyl (meth)acrylate, 2-(vinyloxyethoxy isopropoxy) ethyl (meth)acrylate, 2-(vinyloxyisopropoxyethoxy) ethyl (meth)acrylate, 2-(vinyloxyisopropoxyisopropoxy) ethyl (meth)acrylate, 2-(vinyloxyethoxyethoxy) propyl (meth)acrylate, 2-(vinyloxyethoxy isopropoxy) propyl (meth)acrylate, 2-(vinyloxyisopropoxyethoxy) propyl (meth)acrylate, 2-(vinyloxyisopropoxyisopropoxy) propyl (meth)acrylate, 2-(vinyloxyethoxyethoxy) isopropyl (meth)acrylate, 2-(vinyloxyethoxyisopropoxy) isopropyl (meth)acrylate, 2-(vinyloxyisopropoxyethoxy) isopropyl (meth)acrylate, 2-(vinyloxyisopropoxyisopropoxy) isopropyl (meth)acrylate, 2-(vinyloxyethoxyethoxyethoxy) ethyl (meth)acrylate, 2-(vinyloxyethoxyethoxyethoxyethoxy) ethyl (meth)acrylate, 2-(isopropenoxyethoxy) ethyl (meth)acrylate, 2-(isopropenoxy ethoxyethoxy) ethyl (meth)acrylate, 2-(isopropenoxy ethoxyethoxyethoxy) ethyl (meth)acrylate, 2-(isopropenoxy ethoxyethoxyethoxyethoxy) ethyl (meth) acrylate, polyethylene glycol monovinyl ether (meth)acrylate, and polypropylene glycol monovinyl ether (meth) acrylate, phenoxyethy (meth)acrylate, isobornyl (meth) acrylate, and benzyl (meth)acrylate. Among these, 2-(vinyloxyethoxy) ethyl (meth)acrylate, phenoxyethyl (meth)acrylate, isobornyl (meth)acrylate, and benzyl (meth) acrylate are preferable.

Among these, because it is possible for the viscosity of the ink to be lowered in viscosity, the flash point is high and the curability of the ink is superior, 2-(vinyloxyethoxy) ethyl (meth)acrylate, that is, at least one of either 2-(vinylethoxyethoxy) ethyl acrylate and 2-(vinyloxyethoxy) ethyl methacrylate is preferable, and 2-(vinylethoxyethoxy) ethyl acrylate is more preferable. It is possible for the 2-(vinylethoxyethoxy) ethyl acrylate and the 2-(vinyloxyethoxy) ethyl methacrylate to remarkably lower the viscosity of the ink because either has a simple structure and low molecular weight. Examples of the 2-(vinyloxyethoxy) ethyl (meth)acrylate include 2-(2-vinyloxyethoxy) ethyl (meth) acrylate and 2-(1-vinyloxyethoxy)ethyl (meth)acrylate, and examples of the 2-(vinylethoxyethoxy) ethyl acrylate include 2-(2-vinyloxyethoxy) ethyl acrylate (below, referred to as "VEEA") and 2-(1-vinyloxyethoxy) ethyl acrylate. 2-(vinylethoxyethoxy) ethyl acrylate is superior compared to 2-(vinyloxyethoxy) ethyl methacrylate on the feature of curing properties.

It is preferable that the content of the vinyl ether-containing (meth)acrylate, in particular, 2-(vinyloxyethoxy) ethyl (meth)acrylate is 10 to 70 mass % to the total mass (100 mass %) of the ink composition, and 30 to 50 mass % is more preferable. When the content is 10 mass % or more, it is possible to lower the viscosity of the ink, and the curing properties of the ink become much superior. Meanwhile, when the content is 70 mass % or less, it is possible to maintain a state in which the storage stability of the ink is superior.

Among the (meth)acrylates, examples of the bi-functional (meth)acrylate include, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth)acrylate, EO (ethylene oxide) adduct di(meth)acrylate of bisphenol A, PO (propylene oxide) adduct di(meth)acrylate of bisphenol A, hydroxypivalic acid neopentyl glycol di(meth)acrylate, polytetramethylene glycol di(meth)acrylate, diethylene glycol di(meth)acrylate, tripropylene glycol di(meth)acrylate, and tri-functional or higher (meth)acrylates having a pentaerythritol skeleton or a dipentaerythritol skeleton. Among these, dipropylene glycol di(meth)acrylate is preferable. Among these, dipropylene glycol di(meth)acrylate, tripropylene glycol di(meth)acrylate, diethylene glycol di(meth)acrylate, triethylene glycol di(meth)acrylate, and a tri-functional or higher (meth)acrylate having a pentaerythritol skeleton or dipentaerythritol skeleton are preferable. It is preferable that the ink composition include a polyfunctional (meth)acrylate in addition to the mono-functional (meth)acrylate.

It is preferable that content of the bi-functional or higher polyfunctional (meth)acrylate is 5 to 60 mass % to the total mass (100 mass % or more) of the ink composition, 15 to 60 mass % is more preferable, and 20 to 50 mass % is still more preferable. By setting the above preferable ranges, the curing properties, the storage stability, and the discharge stability tend to be further superior.

Among the above-mentioned (meth)acrylates, examples of the tri-functional or higher polyfunctional (meth)acrylate include, for example, trimethylolpropane tri(meth)acrylate, EO-modified trimethylolpropane tri(meth)acrylate, pentaerythritol tri(meth)acrylate, pentaerythritol tetra(meth) acrylate, dipentaerythritol hexa(meth)acrylate, ditrimethylolpropane tetra(meth)acrylate, glycerin propoxy tri(meth) acrylate, caprolactone-modified trimethylolpropane tri (meth)acrylate, pentaerythritolethoxy tetra(meth)acrylate, and caprolactam modified dipentaerythritol hexa(meth)acrylate. When the ink includes a tri-functional or higher polyfunctional (meth)acrylate, the feature of the curing properties of the ink is preferable, and it is preferable that the content of the polyfunctional (meth)acrylate is 5 to 40 mass % to the total mass (100 mass %) of the ink composition, 5 mass % to 30 mass % is more preferable, and 5 to 20 mass % is still more preferable. Although the upper limit of the number of functional groups of the polyfunctional (meth) acrylate is not limited, hepta-functional or lower is preferable for the feature of low ink viscosity.

Among these, it is preferable that the polymerizable compound includes a mono-functional (meth)acrylate. In this case, the ink composition has low viscosity, the solubility of additives other than the photopolymerization initiator is excellent, and discharge stability is easily obtained during ink jet recording. In order to further increase the toughness, heat resistance, and chemical resistance of the coating film, it is preferable for a mono-functional (meth) acrylate and a bi-functional (meth)acrylate to be used together, and among these, and it is preferable for phenoxyethyl (meth)acrylate and dipropylene glycol (meth)acrylate to be used together.

It is preferable that content of the polymerizable compound is 5 to 95 mass % to the total mass (100 mass %) of the ink composition, and 15 to 90 mass % is more preferable. When the content of the polymerizable compound is within the above ranges, it is possible for the viscosity and the odor to be further lowered, and for the solubility and the reactivity of the photopolymerization initiator to be made still superior.

Hindered Amine Compound

The ink composition used in the embodiment may include a hindered amine compound. Because the hindered amine compound works as a polymerization inhibitor even with little oxygen, it is possible to suppress fixing of the ink composition within the gear pump even in a case where the dissolved oxygen amount is low.

Although not limited to the following, examples of the hindered amine compound include a compound having a 2,2,6,6-tetramethylpiperidine-N-oxyl skeleton, a compound having a 2,2,6,6-tetramethylpiperidine skeleton, a compound having a 2,2,6,6-tetramethylpiperidine-N-alkyl skeleton, and a compound having a 2,2,6,6-tetramethylpiperidine-N-acyl skeleton. By using such a hindered amine compound, the durability of the ink jet apparatus is still superior.

Examples of commercially available hindered amine compounds include ADK STAB LA-7RD (2,2,6,6-tetramethyl-4-hydroxypiperidine-1-oxyl) (trade name, manufactured by ADEKA Corporation), IRGASTAB UV 10 (4,4'-[1,10-dioxo-1,10-decanediyl)bis(oxy)]bis[2,2,6,6-tetramethyl]-1-piperidinyloxy), (CAS No. 2516-92-9), and TINUVIN 123 (4-hydroxy-2,2,6,6,-tetramethyl piperidine-N-oxyl) (all trade names, manufactured by BASF Corporation), FA-711HM, and FA-712HM (2,2,6,6-tetramethyl piperidine dinyl methacrylate, trade name, manufactured by Hitachi Chemical Company, Ltd.), TINUVIN 111 FDL, TINUVIN 144, TINUVIN 152, TINUVIN 292, TINUVIN 765, TINUVIN 770 DF, TINUVIN 5100, SANOL LS-2626, CHIMASSORB 119 FL, CHIMASSORB 2020 FDL, CHIMASSORB 944 FDL, and TINUVIN 622 LD (all trade names, manufactured by BASF Corporation), LA-52, LA-57, LA-62, LA-63P, LA-68LD, LA-77Y, LA-77G, LA-81, LA-82 (1,2,2,6,6,-pentamethyl-4-piperidyl methacrylate), and LA-87 (all trade names, manufactured by ADEKA Corporation).

Among the commercial products, LA-82 is a compound having a 2,2,6,6-tetramethyl piperidine-N-methyl skeleton, and ADK STAB LA-7RD, IRGASTAB UV 10 is a compound having a 2,2,6,6-tetramethyl piperidine-N-oxyl skeleton. Among these, because it is possible for the storage stability and the durability of the ink to be much superior while maintaining superior curing properties, a compound having a 2,2,6,6-tetramethyl piperidine-N-oxyl skeleton is preferable.

Although not limited to the following, specific examples of compounds having a 2,2,6,6-tetramethyl piperidine-N-oxyl skeleton include 2,2,6,6-tetramethyl-4-hydroxypiperidine-1-oxyl, 4,4'-[1,10-dioxo-1,10-decanediyl) bis(oxy)]bis [2,2,6,6-tetra-methyl]-1-piperidinyloxy, 4-hydroxy-2,2,6,6,-tetramethylpiperidine-N-oxyl, bis(1-oxyl-2,2,6,6-tetramethylpiperidin-4-yl) sebacate, and decane diacid bis (2,2,6,6-tetramethyl-1-(octyloxy)-4-piperidinyl) ester.

The other hindered amine compounds may be used independently, or two or more may be used in combination.

The content of the hindered amine compound is preferable 0.05 to 0.5 mass % to the total mass (100 mass %) of the ink composition, 0.05 to 0.4 mass % is more preferable, 0.05 to 0.2 mass % is still more preferable, and 0.06 to 0.2 mass % is particularly preferable. By the content being 0.05 mass % or more, it is possible to suppress fixing of the ink composition within the gear pump, and the durability is superior. By the content being 0.5 mass % or less, the solubility is better.

Other Polymerization-Inhibitor

The ink composition of the embodiment may further include other hindered amine compounds as the polymerization inhibitor. Although not limited to the following, examples of the other polymerization-inhibitor include p-methoxyphenol (hydroquinone monomethyl ether: MEHQ), hydroquinone, cresol, t-butyl catechol, 3,5-di-t-butyl-4-hydroxy toluene, 2,2'-methylene bis(4-methyl-6-t-butylphenol), 2,2'-methylene bis(4-ethyl-6-butylphenol), and 4,4'-thio bis(3-methyl-6-t-butylphenol).

The other polymerization inhibitors may be used independently, or two or more may be used in combination. The content relationship of the other polymerization-inhibitor is determined by the relationship with the content of other components, and is not particularly limited.

Coloring Material

The ink composition may further include a coloring material. It is possible for at least one of a pigment and a dye to be used for the coloring material.

Pigment

It is possible for the light resistance of the ink composition to be improved by using a pigment as the coloring material. It is possible to use either of an inorganic pigment or an organic pigment as the pigment.

It is possible for carbon blacks (C.I. Pigment Black 7) such as furnace black, lamp black, acetylene black, and channel black, iron oxide, and titanium oxide to be used as the inorganic pigment.

Examples of the organic pigment include, azo pigments such as insoluble azo pigments, condensed azo pigments, azo lake, and chelate azo pigments; polycyclic pigments such as phthalocyanine pigments, perylene and perynone pigments, anthraquinone pigments, quinacridone pigments, dioxane pigments, thioindigo pigments, isoindolinone pigments, and quinophthalone pigments; and chelate dyes (for example, a basic dye-type chelate, an acidic dye-type chelate, or the like), lake dyes (for example, a basic dye-type lake, and an acid dye-type lake), nitro pigments, nitroso pigments, aniline black, and daylight fluorescent pigments.

More specifically, examples of the carbon black used in the black ink include No. 2300, No. 900, MCF 88, No. 33, No. 40, No. 45, No. 52, MA7, MA8, MA100, No. 2200B, and the like (all manufactured by Mitsubishi Chemical Corporation); Raven 5750, Raven 5250, Raven 5000, Raven 3500, Raven 1255, Raven 700, and the like (all manufactured by Carbon Columbia Co., Ltd.); Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (manufactured by Cabot Japan K.K.); and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, and Special Black 4 (all manufactured by Degussa AG).

Examples of the pigment used in the white ink included C.I. Pigment White 6, 18, and 21.

Examples of the pigment used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of the pigment used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245, or C.I. Pigment Violet 19, 23, 32, 33, 36, 38, 43, and 50.

Examples of the pigment used in the cyan ink include C.I. Pigment Blue 1, 2, 3, 15, 15:1, 15:2, 15:3, 15:34, 15:4, 16, 18, 22, 25, 60, 65, and 66, and C.I. Vat Blue 4 and 60.

Examples of pigments other than magenta, cyan, and yellow include C.I. Pigment Green 7 and 10, C.I. Pigment Brown 3, 5, 25, and 26, and C.I. Pigment Orange 1, 2, 5, 7, 13, 14, 15, 16, 24, 34, 36, 38, 40, 43, and 63.

The pigments may be used independently or two or more types may be used together.

In cases in which the above pigments are used, it is preferable that the average particle diameter thereof is 300 nm or less, and 50 nm to 200 nm is more preferable. When the average particle diameter is within the above range, it is possible to form an image with excellent image quality along with the reliability, such ejection stability and dispersion stability in the ink composition, being much superior. The average particle diameter in the present specification is measured by a dynamic light scattering method.

Dyes

It is possible for a dye to be used as the coloring material. Acidic dyes, direct dyes, reactive dyes, and basic dyes can be used as the dye without particular limitation. Examples of the dye include C.I. Acid Yellow 17, 23, 42, 44, 79, and 142, C.I. Acid Red, 52, 80, 82, 249, 254, and 289, C.I. Acid Blue 9, 45, and 249, C.I. Acid Black 1, 2, 24, and 94, C.I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The dyes may be used independently or two or more types may be used together.

Because superior concealment and color reproducibility are obtained, it is preferable that the content of the coloring material is 1 to 20 mass % to the total mass (100 mass %) of the ink composition.

Dispersant

In a case in which the ink composition includes a pigment, the composition may further include a dispersant in order to further improve the pigment dispersibility. Although not particularly limited, examples of the dispersant include dispersants commonly used in the preparation of pigment dispersion liquids such as a molecular dispersant. Specific examples thereof include one or more types of polyoxyalkylene polyalkylene polyamine, vinyl-based polymers and copolymers, acrylic polymers and copolymers, polyester, polyamide, polyimide, polyurethane, amino polymers, silicon-containing polymers, sulfur-containing polymers, fluorine-containing polymers, and epoxy resins as a main component. Examples of commercially available high molecular weight dispersants include the Ajisper series manufactured by Ajinomoto Fine-Techno Co., Inc., the Solsperse series (such as Solsperse 36000) available from Avecia Inc or Noveon Inc., the Disperbyk series manufactured by BYK Chemie GmbH, and the Disparion series manufactured by Kusumoto Chemicals, Ltd.

Other Additives

The ink composition may include additives (components) than the additives exemplified above. Although not particularly limited, slipping agents (surfactant), polymerization accelerators, penetration enhancers and wetting agents (moisturizing agents) known in the related art and other additives are possible as such components. Examples of the other additives include fixatives, anti-fungal agents, preservatives, antioxidants, ultraviolet light absorbing agents, chelating agents, pH adjusters, and thickening agents known in the related art.

Preparation of Ink Composition

It is possible to prepare the ink composition by uniformly mixing the dye and other added components as necessary and removing undissolved materials with a filter. The preparation method is not particularly limited, and it is possible to use known methods.

EXAMPLES

Below, although the embodiments of the invention is specifically described using the examples, the invention is not limited to these examples alone.

Preparation of Ink Composition

The ultraviolet-curable ink composition was prepared by adding the components shown in the following Table 1 to achieve the constitutions (unit is mass %) disclosed in Table 1, and stirring the resultant with a stirring device.

TABLE 1

| | |
|---|---|
| C.I. Pigment Black 7 | 2.0 |
| solspers 36000 | 1.0 |
| VEEA | 30.0 |
| PEA | 20.0 |
| DPGDA | 34.8 |
| LA-7RD | 0.1 |
| MEHQ | 0.1 |
| IRGACURE 819 | 5.0 |
| IRGACURE TPO | 5.0 |
| IRGACURE 369 | 2.0 |
| Total | 100.0 |

Usage Raw Material

The raw material of the components shown in Table 1 are as follows.

Coloring Material

C.I. Pigment Black 7 (Microlith Black C-K (trade name), manufactured by BASF Corporation, in the table below, abbreviated to "black pigment")

Dispersant

Solsperse 36000 (trade name, manufactured by Noveon Inc.)

Polymerizable Compound

VEEA (2-(2-vinylethoxyethoxy) ethyl acrylate, trade name, manufactured by Nippon Shokubai Co., Ltd.)

PEA (phenoxyethyl acrylate, trade name, manufactured by Osaka Organic Chemical Industry Ltd. Viscoat #192)

DPGDA (dipropylene glycol diacrylate, trade name SR 508, manufactured by Sartomer Co., Ltd.)

Hindered Amine Compound (Polymerization-Inhibitor)

ADK STAB LA-7RD (2,2,6,6-tetramethyl-4-hydroxy piperidine-1-oxyl, trade name, manufactured by ADEKA Corporation, in the table below, abbreviated to "LA-7RD")

Polymerization-Inhibitor

MEHQ (p-methoxyphenol, manufactured by Tokyo Chemical Industry Co., Ltd.)

Photopolymerization Initiator (Acylphosphine Oxide-Based Compound)

IRGACURE 819 (trade name, BASF Corporation, solid content 100%)

DAROCUR TPO (trade name, manufactured by BASF Corporation, solid content 100%)

(Acetophenone-Based Compound)

IRGACURE 369 (trade name, BASF Corporation, solid content 100%)

Ink Jet Apparatus

A modified ink jet printer Surepress L-4033A (manufactured by Seiko Epson Corporation) was used (below, referred to as a modified device). The modified parts are the feature of including a gear pump, an ink circulation path, an air supply device, a degassing device, and a warming device, and the feature of arranging a light source on the downstream side in the recording medium transport direction of the line head, and being capable of one pass printing using the ultraviolet-curable ink. The arrangement of the gear pump and the like is the same as that shown in FIG. 2. The apparatus will be described below.

The ink flow channel includes an ink circulation path, and includes a degassing device and a warming device in the ink circulation path. An AK55F-S12C (trade name, manufactured by Assist Ltd.) was used as the gear pump, the material of the gear 46 was replaced with polyphenylene sulfide (PPS), and arranged as the circulation pump 82 shown in FIG. 2. In the following Comparative Example 2, a tube pump (tube pump manufactured by Welco Co., Ltd., trade name: WP 1000) was used in place of the gear pump. In Comparative Example 3, a diaphragm pump (diaphragm pump manufactured by Iwaki & Co., Ltd., trade name: LK) was used in place of the gear pump.

As shown in FIG. 2, in Examples 1 to 6 and Comparative Examples 1 to 3, ink jet recording was performed with the air supply membrane surface area of the air supply device, the type of circulation pump 82, the dissolved oxygen amount of the circulation pump 82, the degassing mechanism, and the head dissolved oxygen amount changed, and the aspects of pump durability, discharge stability and discharge amount stability were evaluated. A hollow fiber membrane was used as the air supply membrane of the air supply device. In Table 2, the pump dissolved oxygen amount is the dissolved oxygen amount in the ink immediately before flowing into the circulation pump 82. The head dissolved oxygen amount is the dissolved oxygen amount in the ink immediately before being supplied to the head.

TABLE 2

| | Example | | | | | | Comparative Example | | |
|---|---|---|---|---|---|---|---|---|---|
| | 1 | 2 | 3 | 4 | 5 | 6 | 1 | 2 | 3 |
| Ink flow rate [g/min] | 300 | 300 | 300 | 300 | 300 | 300 | 300 | 300 | 300 |
| Air supply membrane surface area [$m^2$] | 0.4 | 0.3 | 0.5 | 0.6 | 1.0 | 0.6 | None | 0.4 | 0.4 |
| Pump | Gear pump | Gear pump | Gear pump | Gear pump | Gear pump | Gear pump | Gear pump | Tube pump | Diaphragm pump |
| Pump dissolved oxygen amount [ppm] | 10 | 5 | 15 | 20 | 40 | 20 | 1 | 10 | 10 |
| Degassing mechanism | Present | Present | Present | Present | Present | None | Present | Present | Present |
| Head dissolved oxygen amount [ppm] | 6 | 4 | 8 | 10 | 18 | 20 | 1 | 8 | 8 |
| Pump durability | A | B | A | A | A | A | C | C | A |
| Discharge stability | A | A | A | A | C | C | A | A | A |
| Discharge amount stability | A | A | A | A | A | A | A | A | B |

Measurement of Dissolved Oxygen Amount

In the measurement of the dissolved oxygen amount, the dissolved oxygen amount in the ink composition immediately before flowing into the circulation pump 82 or the head 60 was measured using a gas chromatography Aglilent 6890 (manufactured by Agilent Technologies, Inc.). Helium (He) gas was used as the carrier gas. The dissolved oxygen amount in the ink composition indicates, in ppm, the volume of oxygen (gas) in a predetermined volume of the ink composition (liquid).

Evaluation Test

Durability Testing

Ink from the ink cartridge with a dissolved oxygen amount of 2 ppm was charged, and fed using the modified device at an ink flow rate of 300 g/min. The time until the gear locked and the ink could no longer be caused to flow in the gear pump, the time until the tube was damaged and the ink could no longer be caused to flow in the tube pump, and the time until the diaphragm was damaged and ink could no longer be caused to flow in the diaphragm pump were measured, and the durability was evaluated using the following evaluation criteria. When the locked gear pump was disassembled and observed, thickened materials thought to be derived from the ink were attached to the periphery of the gear. It was observed that the engagement portion of the gear was heated during the flow.

Evaluation Criteria

A: longer than 2000 hours

B: longer than 500 hours to 2000 hours or less

C: longer than 24 hours to 500 hours or less

Discharge Stability Test

The ink composition of each example and each comparative example was continuously discharged from one head (600 nozzles) with a discharge frequency of 10 Khz using the modified device. Inspection was performed for the presence of non-discharging nozzles for each one minute discharge, and the accumulated time of the discharge times of the points in time at which non-discharging nozzles were discovered was measured as the continuously dischargeable time. On the basis of this time, the discharge stability was evaluated using the following evaluation criteria.

Evaluation Criteria

A: more than 60 minutes

B: more than 20 minutes to 60 minutes or less

C: more than 10 minutes to 20 minutes or less

D: more than 0 minutes to 10 minutes or less

Discharge Amount Stability Test

The ink composition of each example and each comparative example was continuously discharged for 10 minutes from one nozzle to the recording medium (PET T50A PL Shin Lintec Corporation) while the recording medium is transported, irradiated with ultraviolet rays from the light source (LED) arranged further to the downstream side in the transport direction than the head and the ink attached to the recording medium was cured to form dots. The dot diameter of the dot examples formed was measured and the ratio of the difference between the maximum dot diameter and the minimum dot diameter with respect to the average diameter was calculated. On the basis of this ratio, the discharge amount stability was evaluated using the following evaluation criteria.

Evaluation Criteria

A: 5% or less

B: more than 5%

Comparative Example 3 using the diaphragm pump had very poor discharge amount stability due to the influence of vibration, and the dot diameter periodically appeared larger or smaller. The other pumps had a small difference in dot diameters, and periodic changes were not visible.

Through the above, as long as the ink jet apparatus and method of the invention was used, it was found that the durability and discharge amount stability were superior, and the discharge stability was also superior. In contrast, because Comparative Example 1 did not include an air supply device, the ink composition fixed within the gear pump and the durability was poor. Because Comparative Example 2 used a tube pump in place of the gear pump, the time until the tube was damaged and the ink was not able to be caused to flow was short, the durability was poor. Because Comparative Example 3 used a diaphragm pump in place of the gear pump, the discharge amount stability was very poor due to the influence of vibrations and the dot diameter periodically appeared larger or smaller.

The entire disclosure of Japanese Patent Application No. 2015-051620, filed Mar. 16, 2015 is expressly incorporated by reference herein.

What is claimed is:

1. An ink jet method comprising:

supplying a radiation curable composition to a discharging head via a composition flow channel; and discharging the radiation curable composition from the discharging head, wherein the composition flow channel includes a gear pump that causes the radiation curable composition to flow in the composition flow channel and an air supply mechanism that supplies air to the radiation curable composition further to an upstream side in a flow direction than the gear pump and causes a dissolved oxygen amount in the radiation curable composition to be increased wherein the dissolved oxygen acts as a polymerization inhibitor within the gear pump.

2. The ink jet method according to claim 1, wherein an air supply area of the air supply mechanism is 0.3 $m^2$ to 1.0 $m^2$.

3. An ink jet apparatus that performs recording with the ink jet method according to claim 2.

4. The ink jet method according to claim 1, wherein an ink flow rate of the air supply mechanism is 50 g/min to 400 g/min.

5. An ink jet apparatus that performs recording with the ink jet method according to claim 4.

6. The ink jet method according to claim 1, wherein the dissolved oxygen amount in the radiation curable composition that flows into the gear pump is 6.0 ppm to 30 ppm.

7. An ink jet apparatus that performs recording with the ink jet method according to claim 6.

8. The ink jet method according to claim 1, further comprising:

a degassing mechanism that performs degassing on the radiation curable composition, further to a downstream side than the gear pump.

9. An ink jet apparatus that performs recording with the ink jet method according to claim 8.

10. The ink jet method according to claim 1, wherein the dissolved oxygen amount in the radiation curable composition supplied to the discharging head is 3.0 ppm to 20.0 ppm.

11. An ink jet apparatus that performs recording with the ink jet method according to claim 10.

12. The ink jet method according to claim 1, wherein the dissolved oxygen amount in the radiation curable composition immediately before being supplied to the air supply mechanism is 5 ppm or less.

13. An ink jet apparatus that performs recording with the ink jet method according to claim 12.

14. The ink jet method according to claim 1, wherein the dissolved oxygen amount added by the air supply mechanism is 5 ppm to 40 ppm.

15. An ink jet apparatus that performs recording with the ink jet method according to claim 14.

16. An ink jet apparatus that performs recording with the ink jet method according to claim 1.

17. The ink jet method according to claim 1, wherein the air supply mechanism includes an air supply membrane that is configured so that the air from the external atmosphere passes through the air supply membrane and is supplied to the ink composition.

* * * * *